US009134679B2

(12) United States Patent
Mori

(10) Patent No.: US 9,134,679 B2
(45) Date of Patent: Sep. 15, 2015

(54) DRUM SUPPORTING MECHANISM, PROCESS CARTRIDGE, AND ELECTROPHOTOGRAPHIC IMAGE FORMING APPARATUS

(75) Inventor: Tomonori Mori, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 13/503,931

(22) PCT Filed: Jan. 13, 2011

(86) PCT No.: PCT/JP2011/050904

§ 371 (c)(1),
(2), (4) Date: Apr. 25, 2012

(87) PCT Pub. No.: WO2011/087143

PCT Pub. Date: Jul. 21, 2011

(65) Prior Publication Data

US 2012/0213549 A1 Aug. 23, 2012

(30) Foreign Application Priority Data

Jan. 13, 2010 (JP) ..... 2010-005041
Dec. 27, 2010 (JP) ..... 2010-291339

(51) Int. Cl.
*G03G 15/00* (2006.01)
*G03G 21/18* (2006.01)

(52) U.S. Cl.
CPC ..... *G03G 15/751* (2013.01); *G03G 15/757* (2013.01); *G03G 21/1803* (2013.01); *G03G 2221/1606* (2013.01); *G03G 2221/1654* (2013.01)

(58) Field of Classification Search
CPC ..... G03G 15/751
USPC ..... 399/117
See application file for complete search history.

(56) References Cited

U.S. PATENT DOCUMENTS 3,998,184 A * 12/1976 Hudson ..... 399/228
5,576,803 A * 11/1996 Williams et al. ..... 399/116
5,640,650 A * 6/1997 Watanabe et al. ..... 399/117

(Continued)

FOREIGN PATENT DOCUMENTS

JP 6-202352 7/1994
JP 7-160146 6/1995

(Continued)

OTHER PUBLICATIONS

Office Action in Chinese Patent Application No. 201180005691.9, mailed Jun. 24, 2014 (with English translation).

(Continued)

*Primary Examiner* — David Gray
*Assistant Examiner* — Geoffrey Evans
(74) *Attorney, Agent, or Firm* — Fitzpatrick, Cella, Harper & Scinto

(57) ABSTRACT

A supporting mechanism supporting an electrophotographic photosensitive drum having a photosensitive layer formed through a dip-coating on a peripheral surface of a cylindrical member, said supporting mechanism includes a bearing member supporting the electrophotographic photosensitive drum while contacting such a portion of the photosensitive layer as is away from one axial end of the electrophotographic photosensitive drum which have taken a lower position in the dip-coating, toward an axially central part.

13 Claims, 10 Drawing Sheets

(56) References Cited

U.S. PATENT DOCUMENTS

| | | | | |
|---|---|---|---|---|
| 5,682,581 | A | 10/1997 | Honma et al. | |
| 5,842,086 | A * | 11/1998 | Honma et al. | 399/159 |
| 6,002,897 | A | 12/1999 | Kohno et al. | |
| 6,131,011 | A | 10/2000 | Kojima et al. | |
| 6,157,792 | A | 12/2000 | Mori et al. | |
| 6,178,301 | B1 | 1/2001 | Kojima et al. | |
| 6,240,267 | B1 * | 5/2001 | Compera | 399/117 |
| 6,266,503 | B1 | 7/2001 | Murayama et al. | |
| 6,298,217 | B1 | 10/2001 | Murayama et al. | |
| 6,314,266 | B1 | 11/2001 | Murayama et al. | |
| 6,336,017 | B1 * | 1/2002 | Miyamoto et al. | 399/116 |
| 6,381,429 | B1 * | 4/2002 | Shibata et al. | 399/117 |
| 6,404,996 | B1 | 6/2002 | Mori et al. | |
| 6,826,380 | B2 | 11/2004 | Karakama et al. | |
| 6,915,092 | B2 | 7/2005 | Yamaguchi et al. | |
| 6,980,759 | B2 | 12/2005 | Kanno et al. | |
| 7,082,276 | B2 | 7/2006 | Karakama et al. | |
| 7,158,749 | B2 | 1/2007 | Ueno et al. | |
| 7,184,690 | B2 | 2/2007 | Ueno et al. | |
| 7,231,164 | B2 | 6/2007 | Harada et al. | |
| 7,315,710 | B2 | 1/2008 | Ueno et al. | |
| 7,386,241 | B2 | 6/2008 | Mori et al. | |
| 7,660,550 | B2 | 2/2010 | Mori et al. | |
| 7,890,025 | B2 | 2/2011 | Chadani et al. | |
| 7,899,364 | B2 | 3/2011 | Chadani et al. | |
| 8,116,661 | B2 | 2/2012 | Chadani et al. | |
| 2008/0138115 | A1 * | 6/2008 | Chadani et al. | 399/167 |
| 2008/0181678 | A1 | 7/2008 | Sato et al. | |
| 2010/0329732 | A1 | 12/2010 | Chadani et al. | |
| 2011/0123224 | A1 | 5/2011 | Chadani et al. | |
| 2012/0063810 | A1 | 3/2012 | Chadani et al. | |
| 2012/0128388 | A1 | 5/2012 | Chadani et al. | |
| 2012/0189343 | A1 | 7/2012 | Chadani et al. | |
| 2012/0189344 | A1 | 7/2012 | Chadani et al. | |
| 2012/0230726 | A1 | 9/2012 | Chadani et al. | |

FOREIGN PATENT DOCUMENTS

| | | |
|---|---|---|
| JP | 8-292642 | 11/1996 |
| JP | 10-149056 | 6/1998 |
| JP | 11-160895 | 6/1999 |
| JP | 2003-043813 A | 2/2003 |
| JP | 2004-94108 | 3/2004 |
| JP | 2005070307 | 3/2005 |
| JP | 2005-338751 | 12/2005 |
| TW | 383107 U | 2/2000 |

OTHER PUBLICATIONS

Office Action in Chinese Patent Application No. 201180005691.9, dated Apr. 28, 2015 (with English translation).

* cited by examiner (a)

(b)

(a)

(b)

(a)

(b)

(a)

(b)

DRUM SUPPORTING MECHANISM, PROCESS CARTRIDGE, AND ELECTROPHOTOGRAPHIC IMAGE FORMING APPARATUS

TECHNICAL FIELD

The present invention relates to a drum supporting mechanism, a process cartridge which has a drum supporting mechanism, and an electrophotographic image forming apparatus which has a drum supporting mechanism.

BACKGROUND ART

In the following description of the present invention, an "electrophotographic image forming apparatus" means an apparatus which forms an image on recording medium with the use of an electrophotographic image forming method. Examples of an electrophotographic image forming apparatus include an electrophotographic copying machine, an electrophotographic printer (laser beam printer, LED printer, and the like, for example), a facsimile machine, and the like.

A "drum supporting mechanism" means a mechanism for supporting an electrophotographic photosensitive drum employed by an electrophotographic image forming apparatus.

A "process cartridge" means a cartridge which integrally contains an electrophotographic photosensitive drum and a least one among charging means, developing means, and cleaning means, and also, is removably mountable in the main assembly of an electrophotographic image forming apparatus.

An electrophotographic image forming apparatus (which hereafter will be referred to simply as image forming apparatus), such as an electrophotographic copying machine or a laser beam printer, forms an image through the following image formation sequence: First, it uniformly charges the peripheral surface of its electrophotographic photosensitive member (which hereafter will be referred to simply as photosensitive member), and forms an electrophotographic latent image by selectively exposing the points (pixels) of the uniformly charged portion of the peripheral surface of the photosensitive drum. Then, it develops the electrostatic latent image into a visible image with the use of its developing means, and transfers the visible image, that is, image formed of toner (which hereafter may be referred to simply as developer image or toner image), onto recording medium. Then, it fixes the transferred image to the recording medium. After the transfer, the peripheral surface of the photosensitive drum is cleaned by the cleaning means: the toner remaining on the peripheral surface of the photosensitive drum after the transfer is removed by a cleaning means.

In the field of an image forming apparatus, various image forming apparatuses which employ a process cartridge system have been in practical usage. A process cartridge system integrally places a photosensitive member and one or more processing means in a cartridge so that they can be removably mountable in the main assembly of an image forming apparatus. Thus, a process cartridge system makes it possible to provide an image forming apparatus which is significantly smaller in size and easier to maintain than an image forming apparatus which does not employ a process cartridge system.

Generally, an electrophotographic photosensitive drum is supported by a drum supporting mechanism within the main assembly of an image forming apparatus. More specifically, a photosensitive drum is supported by the drum supporting mechanism, with the presence of a stopper between the photosensitive drum and the main assembly of the image forming apparatus. The stopper is attached to the inward surface of the photosensitive drum (cylindrical member). However, as means for improving an image forming apparatus in terms of the accuracy with which a photosensitive drum is rotated, it has been proposed to directly support a photosensitive drum by its peripheral surface (Japanese Laid-open Patent Application H10-149056).

There has been proposed another drum supporting mechanism (Japanese Laid-open Patent Application No. 4110128). In the case of this drum supporting mechanism, the main assembly of an image forming apparatus is provided with a pair of flat portions for supporting a photosensitive drum by the shaft portion of the photosensitive drum. The two flat portions bear the combination of the multiple forces applied to the photosensitive drum by the multiple processing means which are in contact with the photosensitive drum. This drum supporting mechanism also is intended to improve an image forming apparatus in the accuracy with which a photosensitive drum is rotated.

As for a method for coating the peripheral surface of a cylindrical component (as substrate of photosensitive drum) with photosensitive substance to form a photosensitive layer on the peripheral surface of the cylindrical component, generally, the cylindrical component is dipped into a solution of the photosensitive substance, in such a manner that the axial line of the cylindrical component remains vertical (Japanese Laid-open Patent Application 2004-94108). This method (dip-coating) is problematic in that a photosensitive drum manufactured with the use of this method is not uniform in diameter in terms of its axial direction. More specifically, the lengthwise end portion of a photosensitive drum, which was the bottom end during the manufacture is slightly different (larger) in diameter than the rest. This problem is attributable to the downward settling of the photosensitive substance which occurs after the coating of the substance, and/or the unevenness in the line of separation between the body of photosensitive substance on the peripheral surface of the cylindrical substrate, and the body of photosensitive substance in photosensitive substance container. As one of the solutions to this problem, it has been proposed to coat the peripheral surface of the cylindrical substrate beyond the area of contact between a cleaning member and the peripheral surface of a photosensitive drum, and the portion of the photosensitive drum, which is to be fitted with a seal, in terms of the axial direction of the photosensitive drum (Japanese Laid-open Patent Application H08-292642).

DISCLOSURE OF THE INVENTION

The present invention is one of the further developments of the above-described prior arts. Thus, the primary object of the present invention is to provide an electrophotographic photosensitive drum, the photosensitive layer of which is formed by the dip-coating method, and yet is significantly superior in the accuracy with which it is rotatable, being therefore significantly better in image quality than any electrophotographic photosensitive drum in accordance with the prior arts.

Another object of the present invention is to simplify a mechanism for supporting an electrophotographic photosensitive drum, in order to minimize the effects of the imprecision of the components of the drum supporting mechanism, upon the accuracy with which an electrophotographic photosensitive drum is rotatable.

According to an aspect of the present invention, there is provided a supporting mechanism supporting an electrophotographic photosensitive drum having a photosensitive layer formed through a dip-coating on a peripheral surface of a cylindrical member, said supporting mechanism a bearing member supporting the electrophotographic photosensitive drum while contacting such a portion of the photosensitive layer as is away from one axial end of the electrophotographic photosensitive drum which have taken a lower position in the dip-coating, toward an axially central part.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the preferred embodiments of the present invention are described in detail with reference to the appended drawings. The measurements, materials, and shapes of the structural components in the following preferred embodiments of the present invention, and the positional relationship among the components, are not intended to limit the present invention in scope, unless specifically noted.

Embodiment 1

(Electrophotographic Image Forming Apparatus)

Figure 1:
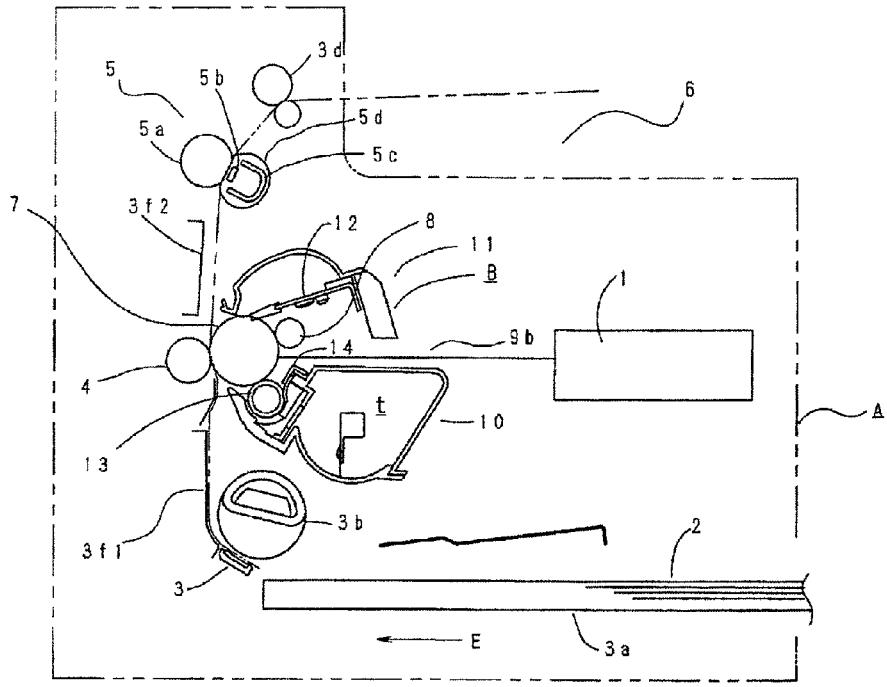
FIG. 1 is a schematic sectional view of the image forming apparatus in the first preferred embodiment of the present invention, and shows the general structure of the apparatus.
Figure 1:
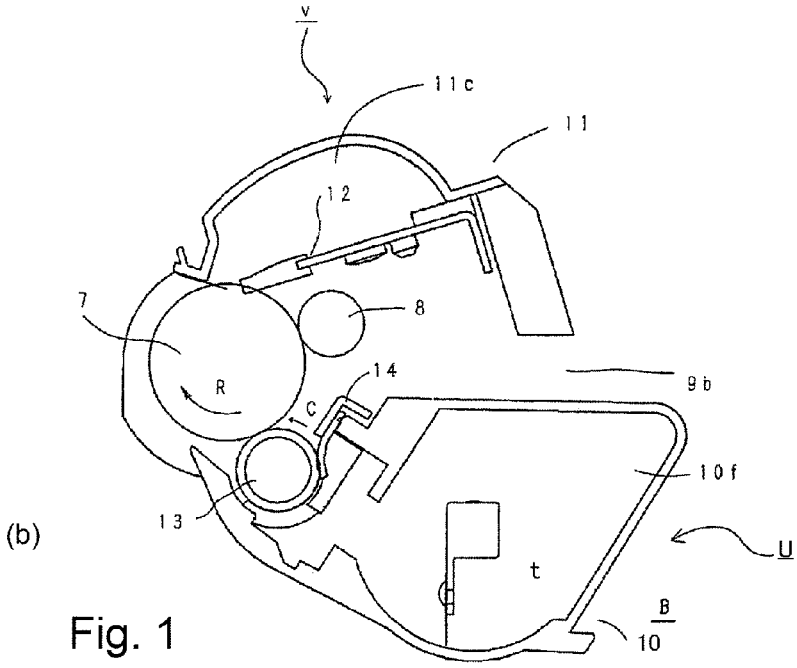

Referring to FIG. 1, the general structure of the image forming apparatus in this embodiment is described. The image forming apparatus in this embodiment uses an electrophotographic image formation process. It employs an electrophotographic photosensitive drum (which hereafter will be referred to simply as photosensitive member or drum). FIG. 1(*a*) is a schematic sectional view the image forming apparatus in this embodiment, when a process cartridge in accordance with the present invention is in its image forming position in the main assembly of the image forming apparatus. FIG. 1(*b*) is a schematic sectional view of the process cartridge in this embodiment, at a vertical plane perpendicular to the lengthwise direction of the cartridge.

First, the image formation process of the image forming apparatus in this embodiment is described. Referring to FIG. 1(*a*), the image forming apparatus has an electrophotographic photosensitive member 7 (which hereafter will be referred to as photosensitive drum), which comprises a cylindrical substrate, and a photosensitive layer formed on the cylindrical substrate by dipping the substrate in the solution of the photosensitive substance. First, the photosensitive drum 7 is scanned by (exposed to) a beam of laser light projected form an optical system while being modulated according to the information of the image to be formed. As a result, an electrostatic latent image is formed on the peripheral surface of the photosensitive drum 7. This photosensitive drum 7 is equivalent to an electrophotographic photosensitive drum in accordance with the present invention.

Then, voltage is applied to a development roller 13, that is, a developer bearing member, on which developer t is present, whereby some of the developer (toner) particles in the developer t are made to transfer onto the photosensitive drum 7. Consequently, a visible image is formed of the developer t on the peripheral surface of the photosensitive drum 7.

Meanwhile a sheet 2 of recording medium (sheet of recording paper, OHP sheet, and the like) is conveyed from a cassette 3*a* by a sheet conveying means 3*b*, while being guided by a pair of sheet guiding plates 3*f*1, in synchronism with the formation of the visible image (image formed of developer).

Then, voltage is applied to a transfer roller 4 (transferring means), whereby the developer image on the photosensitive drum 7 in the process cartridge B is transferred onto the sheet 2 of recording medium, in the image forming portion.

After the transfer of the developer image onto the sheet 2 of recording medium, the sheet 2 is conveyed to a fixing apparatus 5 while being guided by a pair of sheet guiding plates 3*f*2. The fixing apparatus 5 contains a sheet driving roller 5*a*, and a fixation roller 5*d* which has a heater 5*b* in its hollow. The developer image on the sheet 2 of recording medium is fixed to the sheet 2 by being subjected to the heat and pressure applied to the sheet 2 of recording medium and the developer image thereon by the two rollers 5*a* and 5*d*.

After being conveyed through the fixing apparatus 5, the sheet 2 of recording medium is conveyed further by a pair of discharge rollers 3*d*, and then, is discharged by the discharge rollers 3*d* into a delivery tray 6. Incidentally, this image forming apparatus has a combination of a manual feed tray and manual feed rollers. Thus, the sheet 2 of recording medium can be manually fed into the image forming apparatus.

(Process Cartridge)

Next, the process cartridge B, which is removably mountable in the main assembly of an electrophotographic image forming apparatus, is described. The process cartridge B contains the photosensitive drum 7, and a development roller 13 which is a means (component) for forming an electrostatic latent image on the peripheral surface of the photosensitive drum 7 in order to form an image of developer on the peripheral surface of the photosensitive drum 7. That is, the process cartridge B is a cartridge which integrally contains the photosensitive drum 7 and development roller 13.

Referring to FIG. 1(*b*), the image forming operation carried out by the image forming apparatus in this embodiment with the use of the process cartridge B in accordance with the present invention is as follows. First, the photosensitive drum 7 is rotated in the direction indicated by an arrow mark R. As the photosensitive drum 7 is rotated, the peripheral surface of the photosensitive drum 7 is uniformly charged by the charge roller 8 (charging means). The uniformly charged portion of the peripheral surface of the photosensitive drum 7 is scanned by (exposed to) the beam of laser light projected upon the uniformly charged portion of the peripheral surface of the photosensitive drum 7, through an exposure opening 9*b* of the cleaning means frame 11 (photosensitive member supporting frame). As a result, an electrostatic latent image is formed on the uniformly charged portion of the peripheral surface of the photosensitive drum 7. Also referring to FIG. 1(*b*), the process cartridge B has also a developing means container 10, which contains a development blade 14 and the development roller 13. The development blade 14 is for regulating in thickness a uniform layer into which the developer t is formed as it is coated on the peripheral surface of the development roller 13. The developing means container 10 has also a developer storage chamber 10*f*, in which the developer t is stored to be supplied to the development roller 13. The layer of developer t on the peripheral surface of the development roller 13 is regulated in thickness by the development blade 14, becoming thereby uniform in thickness. Then, the developer particles (toner particles) in this uniform layer of developer t on the peripheral surface of the development roller 13 are transferred onto the peripheral surface of the photosensitive member, in the pattern of the electrostatic latent image, by the application of development bias to the development roller 13. Thus, a visible image is formed of the developer, in the pattern of the electrostatic latent image, on the peripheral surface of the photosensitive drum 7. This visible image, that is, the image formed of the developer t, is transferred onto the sheet 2 of recording medium, by the application of transfer bias to the transfer roller 4. The developer t remaining on the photosensitive drum 7 after the transfer of the visible, image (formed of developer t) onto the sheet 2 of recording medium is removed by the cleaning blade 12 (cleaning means), and is collected in the developer storage 11*c* for the removed developer.

The process cartridge B is made of roughly two units, which are a photosensitive member unit v and a development unit u. The photosensitive member unit v comprises a cleaning means holding frame 11, the photosensitive drum 7, the charge roller 8, and the cleaning blade 12. The development unit u comprises the developer container 10, development roller 13, and development blade 14.

Figure 2:
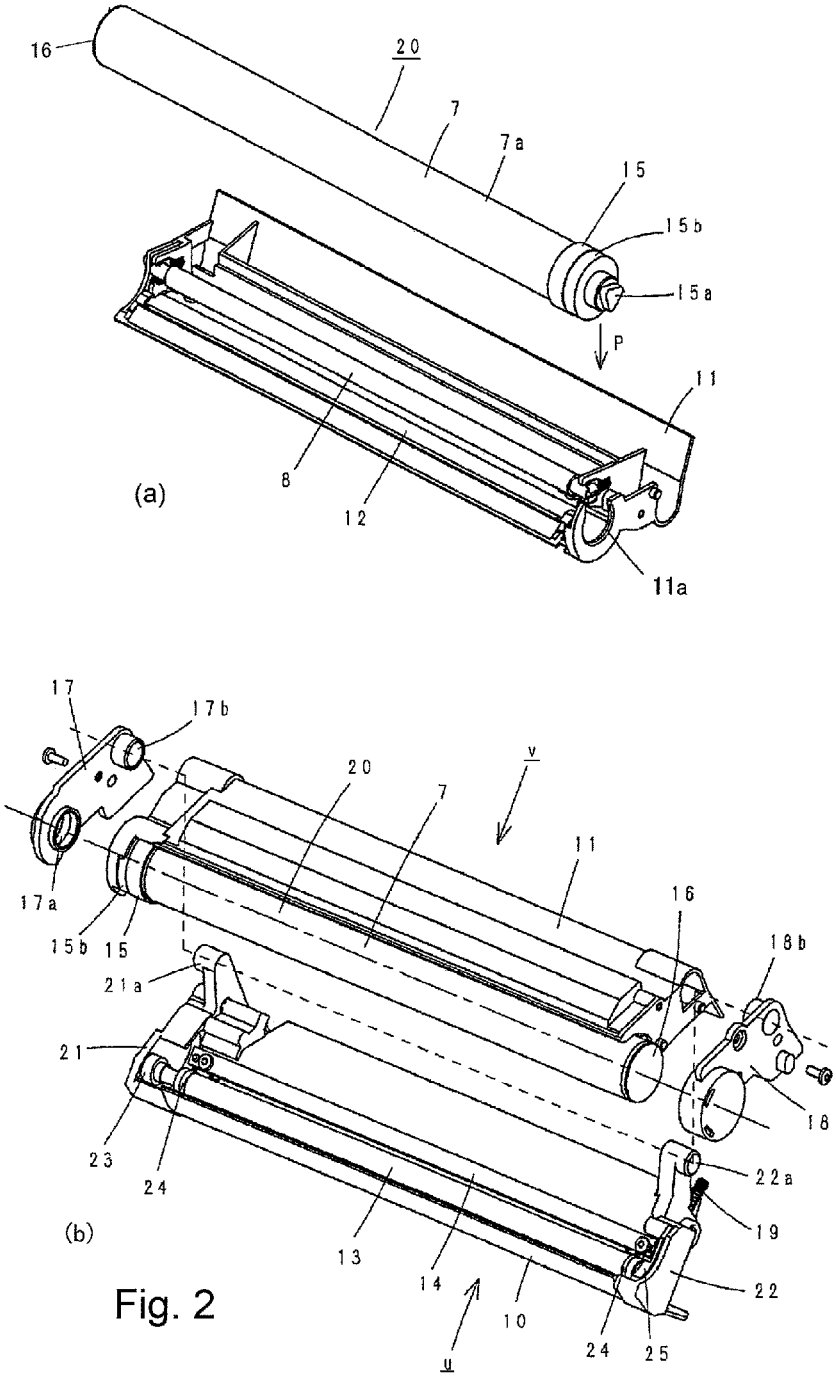
FIG. 2 is a perspective view of the process cartridge in the first preferred embodiment of the present invention, and shows the general structure of the process cartridge.

Next, referring to FIG. 2, the structure of the process cartridge B is described.

The drum unit 20, which is a part of the photosensitive member unit v, has: the photosensitive drum 7, the surface layer of which is a photosensitive layer 7*a*; and a pair of stoppers 15 and 16, which are at the lengthwise ends of the photosensitive drum 7, one for one, in terms of the axial direction of the photosensitive drum 7. Here, the "axial direction" means the direction parallel to the axial line of the photosensitive drum 7. The stopper 15 is fitted around one of the lengthwise end portions of the photosensitive drum 7, and is solidly attached to the photosensitive drum 7 with bonding means such as adhesive. The stopper 15 has a coupler portion 15*a*, which receives the rotational force from the main assembly of the image forming apparatus and transmits the force to the photosensitive drum 7. The stopper 16, which is at the opposite end of the photosensitive drum 7 from where the stopper 15 is, is within the photosensitive drum 7. It is attached to the inward surface of the photosensitive drum 7. The bonding means used to attach the stopper 16 is the same bonding means as the one used to attach the stopper 15.

The procedure for attaching the drum unit 20 to the cleaning means holding frame 11 is as follows: First, the cleaning blade 12 and charge roller 8 are attached to the cleaning means frame 11. Then, the drum unit 20 is attached to the cleaning means holding frame 11 in such a manner that the stopper 15 of the drum unit 20 fits into the groove 11*a* of the cleaning means frame 11 in the direction indicated by an arrow mark P as shown in FIG. 2(*a*).

Then, the drum unit 20 and development unit u are positioned relative to the cleaning means frame 11 in such a manner that they can be held to the cleaning means frame 11 by a pair of drum bearings 17 and 18, which are to be attached to the lengthwise ends of the cleaning frame 11, in terms of the axial direction, as shown in FIG. 2(*b*). The drum bearing 17 has a pair of cylindrical portions 17*a* and 17*b*, which correspond in position to the drum unit 20 and development unit u, respectively, whereas the drum bearing 18 has a pair of cylindrical portions 18*a* and 18*b*, which correspond in position to the drum unit 20 and development unit u. The supporting shafts 21*a* and 22*a* of the development unit u are fitted into the cylindrical portion 17*b* of the drum bearing 17, and the cylindrical portion 18*b* of the drum bearing 18, respectively, whereby the development unit u is supported by the drum bearings 17 and 18.

The development roller 13 is rotatably supported by the development roller holder 21 and development roller bearing 25; one of the lengthwise ends of the development roller 13 is supported by the development roller holder 21, and the other end is supported by the development roller bearing 25. One of the lengthwise ends of the development roller 13 is provided with a development roller gear 23, and the stopper 15 is provided with the gear 15*b*, which meshes with the development roller gear 23. Thus, the force for driving the development roller 13 is transmitted to the development roller 13 as the gear 15*b* (photosensitive drum 7) is driven by the mechanical power source of the main assembly of the image forming apparatus.

The lengthwise end portions of the development roller 13 are fitted with a pair of spacer rings 24, one for one. Further, the lengthwise ends of the development unit u are provided with a pair of compression springs 19, one for one. Thus, after the attachment of the drum unit 20 and development unit u to the cleaning means frame 11, the development unit u remains under the pressure from the pair of compression springs 19, whereby the pair of space rings 24 are kept in contact with the peripheral surface of the photosensitive drum 7, ensuring thereby that a preset amount of gap is maintained between the peripheral surface of the photosensitive drum 7 and the peripheral surface of the development roller 13. That is, the spacer rings 24 remain sandwiched between the peripheral surface of the photosensitive drum 7 and the peripheral surface of the development roller 13, and therefore, the thickness of the spacer rings 23 is the preset gap between the peripheral surface of the photosensitive drum 7 and the peripheral surface of the development roller 13.

(Mechanism for Supporting Lengthwise End of Photosensitive Drum, by which Drum is not Driven)

Figure 3:
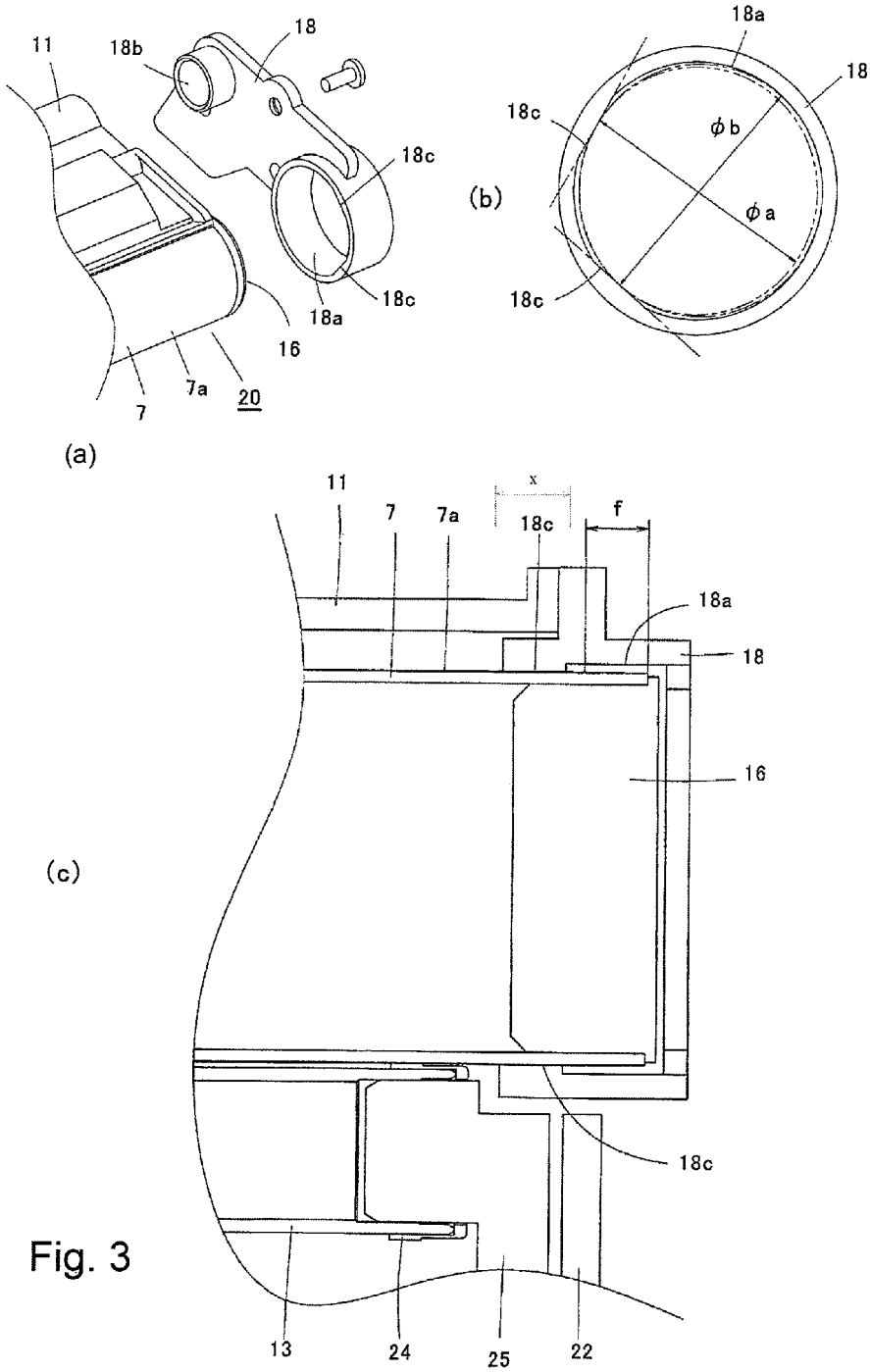
FIG. 3 is a schematic drawing of the mechanism for supporting the lengthwise end of the photosensitive drum, by which the photosensitive drum is not driven, in the first preferred embodiment.
Figure 4:
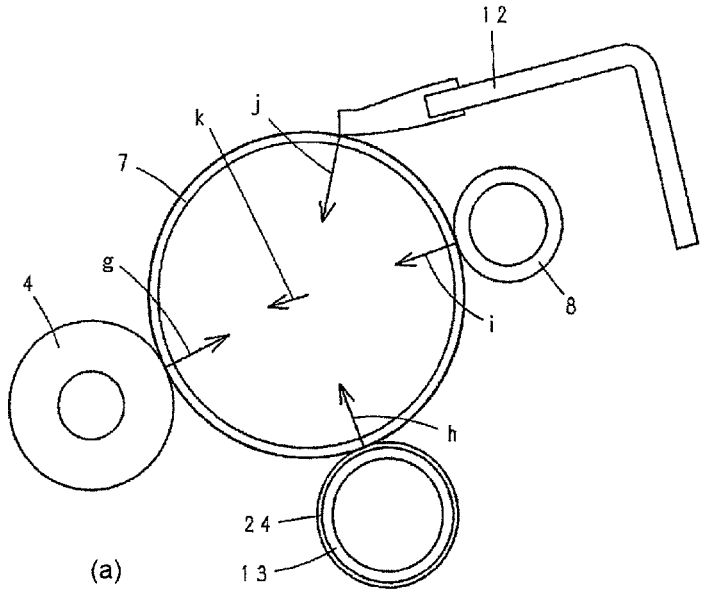
FIG. 4 is a schematic drawing for showing the multiple forces which act on the photosensitive drum, in the first preferred embodiment.
Figure 4:
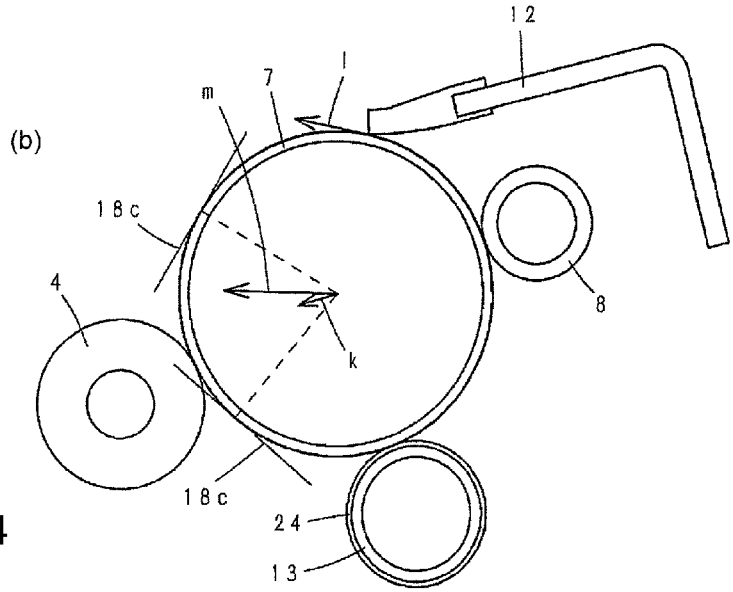
Figure 5:
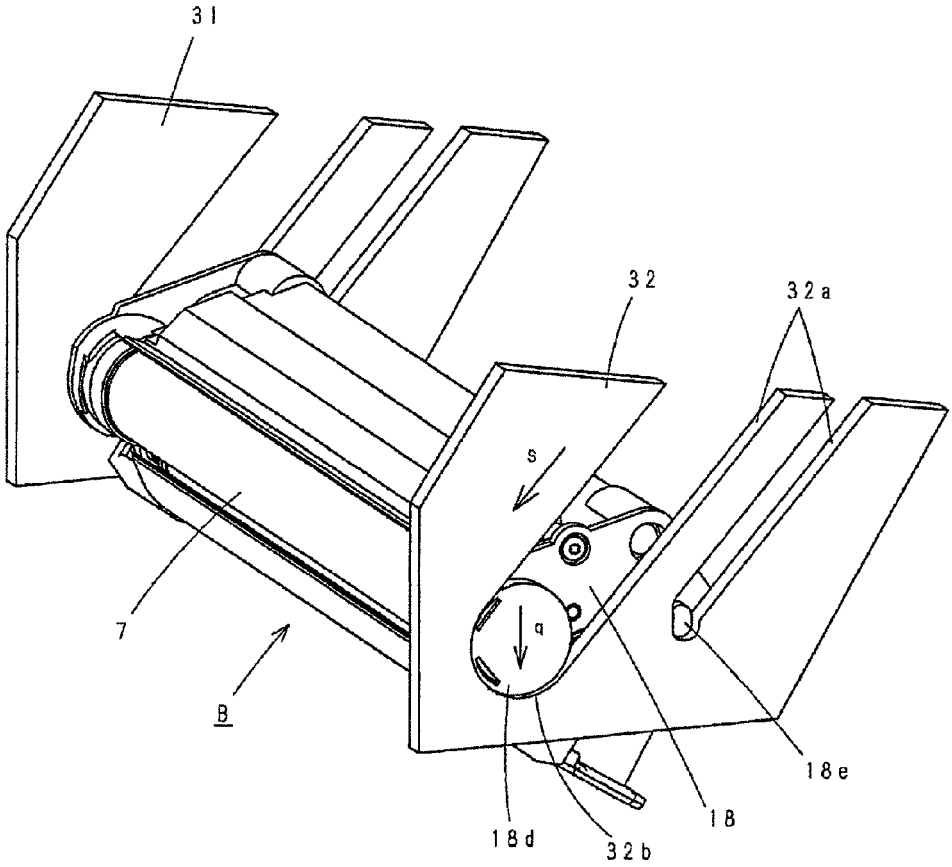
FIG. 5 is a perspective view of the process cartridge B and process cartridge guiding means in the first preferred embodiment, and shows how the lengthwise end of the process cartridge B, by which the process cartridge B is not driven, is guided by the guiding means when the process cartridge B is mounted.

Next, referring to FIGS. 3-5, the mechanism for supporting the lengthwise wise end of the photosensitive drum 7, by which the photosensitive drum 7 is not driven, is described. Referring to FIG. 3, one of the lengthwise end portions of the photosensitive drum 7 is fitted in the cylindrical portion 18*a* of the drum bearing 18, being thereby supported by the bearing 18.

Referring again to FIG. 3, the shape of the hole of the cylindrical portion 18*a* of the drum bearing 18 is described. The photosensitive layer 7*a* of the photosensitive drum 7 is formed by dipping the cylindrical substrate for the photosensitive drum 7, into the solution of photosensitive substance in a vat, in such a manner that the axial line of the cylindrical substrate remains roughly vertical. Thus, the bottom end portion of the photosensitive layer 7*a*, in terms of the direction in which the cylindrical substrate is dipped into the solution of photosensitive substance, becomes thicker than the rest of the photosensitive layer 7*a*, because of the downward settling, or the like, of the body of the solution of photosensitive substance on the peripheral surface of the cylindrical substrate. Therefore, at least the portion of the photosensitive layer 7*a*, which corresponds in position to the end portion of the photosensitive drum 7, which was at the bottom when the photosensitive layer 7*a* was formed, has to be removed so that the photosensitive drum 7 can be fitted with the stopper 16. Thus, this portion of the photosensitive layer 7*a* is removed from the peripheral surface of the cylindrical substrate of the photosensitive drum 7. However, even after the removal of this portion of the photosensitive layer 7*a*, the portion of the photosensitive layer 7*a*, which is within a range f of roughly 5 mm from the bottom end of the photosensitive drum 7, sometimes remains roughly several tens of micrometers thicker than the rest of the photosensitive layer 7*a*. Thus, the drum bearing 18 is formed so that the internal diameter ϕb of its cylindrical portion 18*a* is larger than the diameter ϕa of the portion of the photosensitive drum 7, which corresponds in position to the portion of the photosensitive layer 7*a*, which is in the range f. Thus, the drum bearing 18 can be easily fitted around the photosensitive drum 7; when the photosensitive drum 7 is put through the cylindrical portion 18*a* of the drum bearing 18 to assembly the drum unit 20, the inward surface of the cylindrical portion 18*a* of the drum bearing 18 does not interfere with the portion of the photosensitive layer 7*a*, which corresponds in position to the range f.

Referring to FIG. 3(*b*), the internal surface of the cylindrical portion 18*a* is provided with a pair of flat portions 18*c*, which support the photosensitive drum 7 by remaining in contact with the peripheral surface of the photosensitive drum 7. First, the positioning of these flat portions 18*c* is described in terms of the axial direction. Referring to FIG. 3(*c*), each flat portion 18*c* is on the inward side the range f in which the photosensitive layer 7*a* is nonuniform in thickness because of the aforementioned downward settling of the body of the solution of photosensitive substance and/or nonuniformity in the line of separation of the body of the liquid photosensitive substance on the cylindrical substrate for the photosensitive drum 7 from the body of the solution of photosensitive substance in the vat. Thus, the flat portion 18*c* supports the photosensitive drum 7 by remaining in contact with the portion of the photosensitive layer 7*a*, which is inward of the range f. More specifically, the flat portion 18*c* supports the photosensitive drum 7 by remaining in contact with the portion of the photosensitive layer 7*a*, which is in a range x, which is closer to the center of the photosensitive drum 7 in terms of the axial direction.

Next, referring to FIG. 4, the positioning of the two flat portions 81*c* of the drum bearing 18 relative to each other in terms of the rotational direction of the photosensitive drum 7 is described. Referring to FIG. 4(*a*) which shows the multiple forces to which the photosensitive drum 7 is subjected when the photosensitive drum 7 is not driven, that is, when the photosensitive drum 7 is stationary, the photosensitive drum 7 is subjected to the force h which is applied by each of the spacer ring 24 with which each of the lengthwise end portions of the development roller 13 is fitted, and the forces i, j, and g applied by the charge roller 8, cleaning blade 12, and transfer roller 4, respectively. That is, the photosensitive drum 7 is subjected to the force, indicated by an arrow mark k, which results from these forces h, I, j, and g. Incidentally, the length of each arrow mark in FIG. 4(*a*) indicates the amount of the corresponding force.

Next, referring to FIG. 4(*b*), the forces to which the photosensitive drum 7 is subjected as the photosensitive drum 7 is driven is described. As the photosensitive drum 7 is driven, the photosensitive drum 7 is subjected to not only the force k, but also, the friction from the cleaning blade 12, indicated by an arrow mark l, which acts on the photosensitive drum, primary when the photosensitive drum 7 is driven. Thus, it is a force m resulting from the combination of the force k (to which photosensitive drum 7 is subjected when photosensitive drum 7 is not driven) and force l (friction) that the photosensitive drum 7 is subjected to when the photosensitive drum 7 is driven. That is, as the photosensitive drum 7 is driven, it is subjected to the force m which results from the combination of the forces k resulting from the combination of the pressures from multiple processing means (components) which press upon the photosensitive drum 7, and the force I (friction) which is generated as the photosensitive drum 7 is driven. Thus, the flat portions 18*c* of the drum bearing 18 are positioned to satisfactorily bear the force m, that is, the force which results from the sum of the multiple forces which the multiple processing means apply to the photosensitive drum 7 when the photosensitive drum 7 is stationary and also, when it is being driven. Further, these forces are utilized to position the photosensitive drum 7 between the two flat portions 18*c*. In other words, the photosensitive drum 7 is properly positioned by being in contact with the two flat portions 18*c* of the drum bearing 18 under both conditions (whether photosensitive drum 7 is remaining stationary or being driven).

Next, referring to FIG. 5, the positioning of the process cartridge B relative to the main assembly of an image forming apparatus is described. The process cartridge B is to be inserted into the main assembly of the image forming apparatus in the direction indicated by an arrow mark s so that the cartridge positioning portions 18*d* and 18*e* of the drum bearing 18 fit into the two grooves 32*a* of a cartridge guiding member 32. After the completion of the insertion, the process cartridge B is pressed in the direction indicated by an arrow mark q by an unshown pressure applying member, whereby the positioning portion 18*d* is placed in contact with the cartridge positioning portion 32*b* of the guiding member 32, accurately positioning thereby the photosensitive drum 7 relative to the main assembly of the image forming apparatus, in the main assembly.

Next, the effects of the above described structural features are described. Firstly, the diameter ϕb of the hole of the cylindrical portion 18*a* is larger than the diameter ϕa of the lengthwise end portion of the photosensitive drum 7, which was the bottom end portion when the cylindrical substrate for the photosensitive drum 7 was dipped into the solution of liquid photosensitive substance in such a manner that the axial line of the cylindrical substrate remained vertical, in order to coat the peripheral surface of the substrate with the solution of photosensitive substance. This structural feature improves in efficiency the assembly step for fitting the drum bearing 18 around the photosensitive drum 7. Secondly, the photosensitive drum 7 is positioned relative to the photosensitive drum supporting portions, that is, the two flat portions 18 of the internal surface of the hole of the cylindrical portion 18*a* of the bearing 18, by the combination of the forces applied to the photosensitive drum 7 by the multiple means for processing the photosensitive drum 7. This structural feature prevents the photosensitive drum 7 from changing in position relative to the bearing 18. Therefore, it improves the process cartridge B in the accuracy with which the photosensitive drum 7 is rotated.

Thirdly, the two flat portions 18*c* with which the photosensitive drum 7 comes into contact, being thereby supported by the flat portions 18*c*, support the photosensitive drum 7 by the portion of the photosensitive drum 7, which is closer to the center of the photosensitive drum 7, in terms of the axial direction, than the portion of the photosensitive layer 7*a*, which is in the range f. Therefore, the rotation of the photosensitive drum 7 is not affected by the unevenness of the photosensitive layer 7*a* in terms of thickness. Thus, this structural feature also improve the process cartridge B in the accuracy with which the photosensitive drum 7 is rotated.

(Mechanism for Supporting Lengthwise End Portion of Photosensitive Drum, by which Photosensitive Drum is Driven)

Next, the mechanism for supporting the lengthwise end of the photosensitive drum 7, by which the photosensitive drum 7 is driven, is described.

Figure 6:
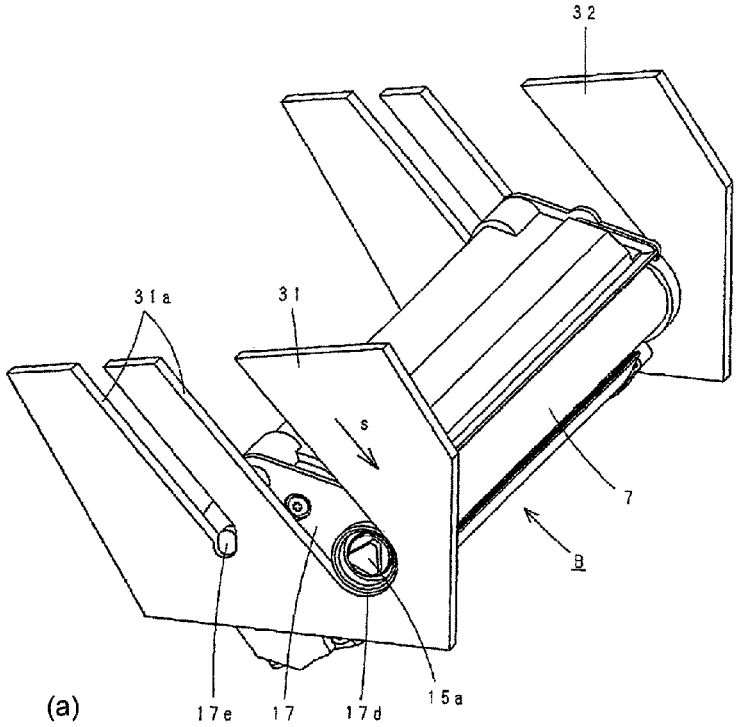
FIG. 6 is a perspective view of the process cartridge B and process cartridge guiding means in the first preferred embodiment, and shows how the lengthwise end of the process cartridge B, by which the process cartridge B is driven, is guided by the guiding means when the process cartridge B is mounted.
Figure 6:
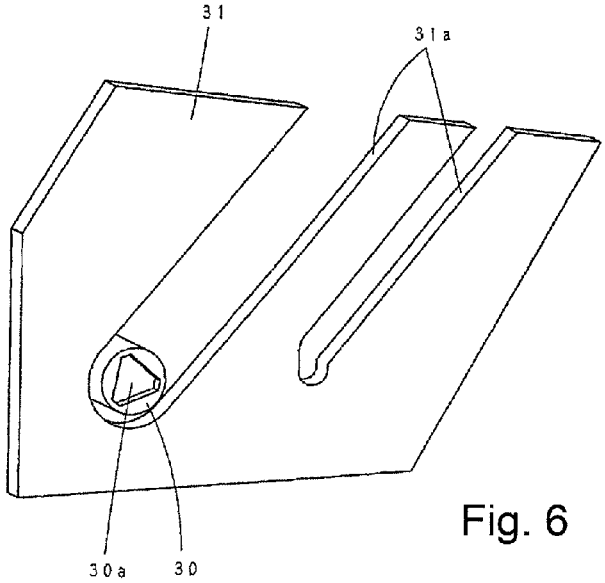

First, referring to FIG. 6, how the process cartridge B is to be mounted into the main assembly of the image forming apparatus is described. The process cartridge B is to be inserted into the main assembly of the image forming apparatus in the direction indicated by an arrow mark s in such a manner that the cartridge guiding bosses 17*d* and 17*e* of the drum bearing 17, which correspond in position to the lengthwise end of the process cartridge B, from which the process cartridge B is driven, fit into the cartridge guiding groove 31*a* of the cartridge guiding member 31. Referring to FIG. 6(*b*), the main assembly of the image forming apparatus is provided with a coupler 30 (female coupler), which engages with the coupler portion 15*a* (male coupler) of the process cartridge B to transmit mechanical force for driving the photosensitive drum 7. The positioning of the lengthwise end of the photosensitive drum 7 by which the photosensitive 7 is driven, relative to the main assembly of the image forming apparatus is different from the positioning of the lengthwise end of the photosensitive drum 7 by which the photosensitive drum 7 is not driven, relative to the main assembly of the image forming apparatus, in that the former is positioned relative to the main assembly by the coupler 30 instead of the cartridge guiding member (which is guiding member 31).

Figure 7:
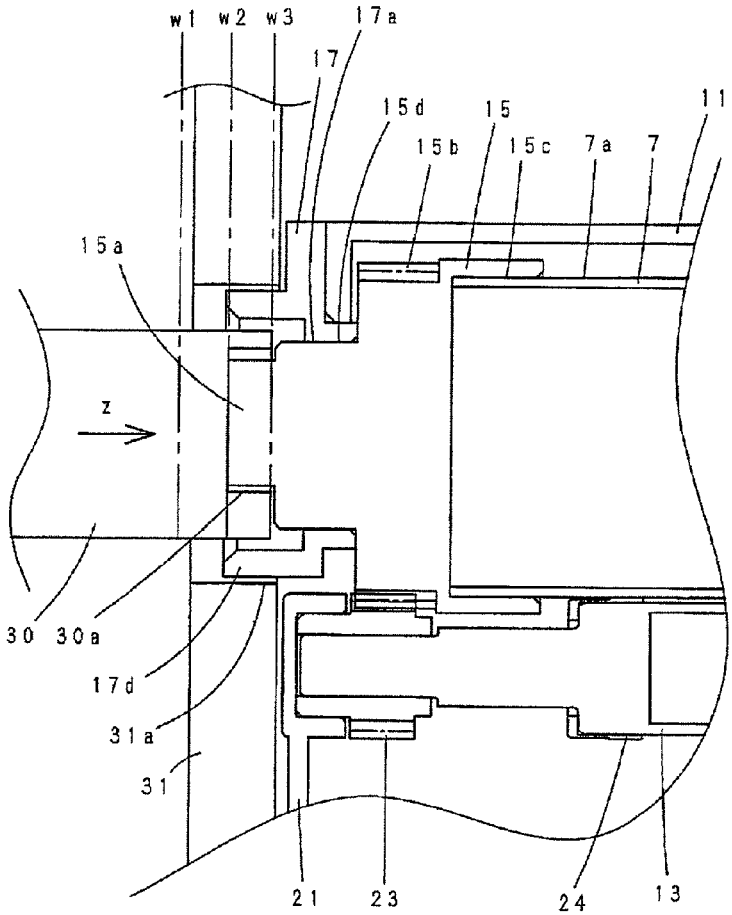
FIG. 7 is a schematic drawing of the mechanism for supporting the lengthwise end of the photosensitive drum, by which the photosensitive drum is driven, in the first preferred embodiment.
Figure 7:
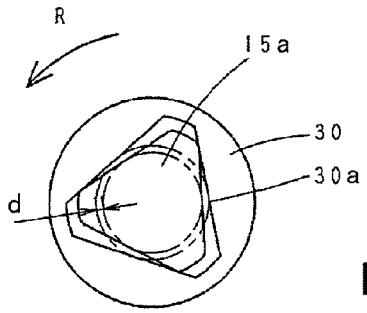

FIG. 7(*a*) is a schematic sectional view of the mechanism for supporting the lengthwise end of the photosensitive drum 7, by which the photosensitive drum 7 is driven, at a plane which coincides with the axial line of the photosensitive drum 7. First, the movement of the coupler 30 of the main assembly of the image forming apparatus in the axial direction is described from the beginning of the insertion of the process cartridge B into the main assembly to the point in time at which the process cartridge B begins to be driven. Until the completion of the insertion of the process cartridge B into the main assembly of the image forming apparatus, the coupler 30 of the main assembly remains retracted in a position indicated by a line w1 in the drawing, so that its coupling end does not interfere with the insert of the process cartridge B.

As soon as the process cartridge B is completely inserted into the main assembly of the image forming apparatus, the coupler 30 moves so that its coupling end moves into a range between lines w2 and w3 in the drawing. The main assembly of the image forming apparatus is structured so that the coupler 30 is moved by the movement of a door (unshown) of the main assembly of the image forming apparatus, which occurs when the process cartridge B is mounted into, or removed from, the main assembly. It is within this range between the lines w2 and w3 in the drawing that as the coupling end of the coupler 30 is moved into by the movement of the door, it comes into contact with the coupler portion 15*a* of the stopper 15 of the process cartridge B. The coupler 30 is under the pressure applied thereto in the direction indicated by an arrow mark z by an unshown pressure applying means.

Then, as the coupler 30 is driven, the coupler 30 and coupler portion 15*a* of the coupler 15 synchronize with each other in rotational phase, allowing thereby the coupler 30 to be moved by the pressure from the aforementioned unshown pressure applying means to the position indicated by the line w3 in the drawing; the coupler 30 couples with the coupler portion 15*a* of the stopper 15. FIG. 7(*b*) is a schematic sectional view of the couplers 30, and coupler portion 15*a* of the stopper 15, at a plane which is perpendicular to the axial line of the photosensitive drum 7 and cuts across the joint between the coupler 30 and the coupler portion 15*a* of the stopper 15. As the coupler 30 is driven in the direction indicated by an arrow mark R, the axial line of the coupler portion 15*a* (male coupler) of the stopper 15 of the process cartridge B, which is triangular in cross section, is aligned with the axial line of the coupler 30 by the rotational force applied to the surfaces of the coupler portion 15*a* by the wall of the coupling recess of the coupler 30 in the direction indicated by the arrow mark R. Thus, the driving force from the main assembly of the image forming apparatus is transmitted to the process cartridge B without misalignment between the axial line of the coupler 30 and the axial line of the stopper 15.

Next, referring to FIG. 7(*a*), the photosensitive drum 7 is supported by the inward surface 15*c* of the cylindrical portion of the stopper 15, being thereby precisely positioned relative to the main assembly of the image forming apparatus; the peripheral surface of the photosensitive drum 7 remains in contact with the inward surface 15*c* of the cylindrical portion of the stopper 15. Further, the coupler portion 15*a* of the stopper 15 fits into the coupling recess 30*a* of the coupler 30 of the main assembly of the image forming apparatus, whereby the stopper 15 and coupler 30 are aligned with each other as described above. Consequently, the photosensitive drum 7 becomes precisely positioned relative to the main assembly.

Next, referring to FIG. 7(*a*), the roles played by the guiding boss 17*d*, guiding groove 31*a*, coupler 30, and coupler portion 15*a* of the stopper 15 when the process cartridge B is mounted into the main assembly of the image forming apparatus are described. FIG. 7(*a*) shows the positional relationship between the coupler 30 and the coupler portion 15*a* of the stopper 15 after the photosensitive drum 7 was precisely positioned relative to the main assembly through the alignment of the coupler 30 and coupler portion 15*a* of the stopper 15 by the transmission of the cartridge driving force from the main assembly to the process cartridge B. In FIG. 7(*a*), there is a gap between the guiding boss 17*d* of the drum bearing 17 and the guiding surface of the guiding groove 31*a*, and therefore, the guiding boss 17*d* and guiding surface of the guiding groove 31*a* do not precisely position the photosensitive drum 7. That is, it is only temporarily that they function as the means for precisely positioning the photosensitive drum 7.

More specifically, it is only during the period in which the coupler 30 and coupler portion 15*a* are aligned with each other by the transmission of the cartridge driving force from the coupler 30 to the coupler portion 15*a* that the guiding boss 17*d*, and the guiding surface of the guiding groove 31*a*, precisely position the photosensitive drum 7.

Thus, even if there is a deviation between the axial line of the coupler 30 and the axial line of the coupler portion 15*a* in terms of their radius direction, the deviation is tolerable during the coupling between the coupler 30, and the coupler portion 15*a* of the stopper 15, because of the difference d in radius between the inscribing circle of the coupler 30 and the circumscribing circle of the coupler portion 15*a*. This difference d in radius is set to be greater than the amount of the temporarily deviation caused by the guiding boss 17*d* and guiding groove 31*a*. Therefore, as the triangular recess of the coupler 30 and the triangular coupler portion 15*a* of the stopper 15 synchronize in phase with each other, the coupler 35 and coupler portion 15*a* remain engaged with each other while being in precisely aligned with each other.

Next, the effects of the above described structural features are described. Firstly, the stopper 15, which is a member to which the process cartridge (photosensitive drum) driving force is directly transmitted from the main assembly of the image forming apparatus, is fitted around the peripheral surface of the lengthwise end portion of the photosensitive drum 7, which was the top end portion of the photosensitive drum 7, being therefore free of the settling of the solution of photosensitive substance, and/or nonuniformity attributable to the separation of the body of the solution of photosensitive substance on the peripheral surface of the cylindrical substrate from the body of the solution of photosensitive substance in the vat, when the cylindrical substrate for the photosensitive drum 7 was dipped into the solution of photosensitive substance to form the photosensitive layer 7*a* on the peripheral surface of the substrate. This structural feature can reduce the number of components which the process cartridge B requires to support the photosensitive drum 7 and to transmit the driving force to the photosensitive drum 7 from the coupler 30, which is the driving force transmitting member of the main assembly of the image forming apparatus. That is, not only can this structural feature simplify the drum supporting mechanism, but also, can minimize the effect of the component inaccuracy upon the accuracy with which the photosensitive drum 7 is rotated, and therefore, can improve an image forming apparatus in the accuracy with the photosensitive drum 7 is rotated.

Further, the stopper 15 is utilized as the member for transmitting driving force to the photosensitive drum 7 from the main assembly of the image forming apparatus. Further, the coupler portion 15*a* of the stopper 15 is shaped so that it can function to align the coupler 30 and the coupler portion 15*a*, which in turn makes it possible to reliably engage the coupler 30 and the coupler portion 15*a* of the stopper 15 while precisely aligning the coupler 30 and coupler portion 15*a*.

Further, the photosensitive drum 7, the photosensitive layer 7*a* of which is formed by dip-coating the solution of photosensitive substance on the cylindrical substrate for the photosensitive drum 7, is directly supported by its peripheral surface, instead of the inward surface of the cylindrical substrate. Thus, the photosensitive drum 7 can be precisely supported regardless of the nonuniformity of the cylindrical substrate of the photosensitive drum 7 in terms of thickness. Further, it is not by the portion of the photosensitive layer 7*a* in the range f in which the photosensitive layer 7*a* is thicker due to the aforementioned downward settling of the solution of the photosensitive substance and/or the nonuniformity attributable to the separation of the body of the solution of the photosensitive substance on the peripheral surface of the cylindrical substrate from the body of the solution of photosensitive substance in the vat that the drum bearing 18 supports the photosensitive drum 7. These two structural features can improve the process cartridge B in terms of the accuracy with which the photosensitive drum 7 is rotated.

Further, also at the other end of the photosensitive drum 7, that is, the end which was the top end when the cylindrical substrate for the photosensitive drum 7 was dip-coated with the solution of the photosensitive substance, the photosensitive drum 7 was directly supported by its peripheral surface. Not only can this structural feature make it possible to precisely support the photosensitive drum 7, but also, to improve the image forming apparatus in terms of the accuracy with which the photosensitive drum 7 is rotated. Further, neither end of the photosensitive drum 7 is supported by the inward surface of the cylindrical substrate of the photosensitive drum 7. This structural feature makes it unnecessary to extremely strictly control the process of manufacturing the cylindrical substrate for the photosensitive drum 7, in terms of the thickness of the wall of the cylindrical substrate, which in turn makes it possible to reduce in cost the cylindrical substrate for the photosensitive drum 7.

Further, the diameter of the hole of the cylindrical portion 18*a* of the drum bearing 18 is made larger than the external diameter of the portion of the photosensitive drum 7 in the range f in which the photosensitive layer 7*a* is thicker than in other range. This structural feature prevents the inward surface of the hole of the cylindrical portion 18*a* from interfering with the portion of the photosensitive drum 7, which is in the range f. Thus, it makes it easier to put the photosensitive drum 7 through the drum bearing 18. Therefore, it makes it easier to assemble the drum supporting mechanism. Further, the inward surface of the hole of the cylindrical portion 18*a* of the drum bearing 18 is provided with two flat portions 18*c*, by which the drum bearing 18 catches the force m resulting from the combination of the force k resulting from the multiple forces applied to the photosensitive drum 7 by the means for processing the photosensitive drum 7, and the frictional force I. This structural feature makes it possible for the photosensitive drum 7 to be precisely positioned relative to the main assembly of the image forming apparatus by being kept in contact with the two flat portions 18*c*, making it thereby possible for the photosensitive drum 7 to be precisely positioned relative to the main assembly even though the cylindrical portion 18*a* of the drum bearing 18 is greater in diameter than the portion of the photosensitive drum 7 by which the photosensitive drum 7 is supported by the bearing 18. Thus, it can prevent the photosensitive drum 7 from changing position in the cylindrical portion 18*a*, and therefore, can improve an image forming apparatus in the accuracy with which the photosensitive drum 7 is rotated.

Further, the drum bearing 17 for the photosensitive drum 7 is utilized as the member for transmitting driving force to the photosensitive drum 7. This structural feature reduces the number of components involved in the supporting of the photosensitive drum 7 and the transmission of driving force to the photosensitive drum 7. Thus, it can minimize the problem that the accuracy with which the photosensitive drum 7 is rotated is reduced by the impreciseness of the components, and therefore, can improve an image forming apparatus in the accuracy with which the photosensitive drum 7 is rotated.

Embodiment 2

Figure 8:
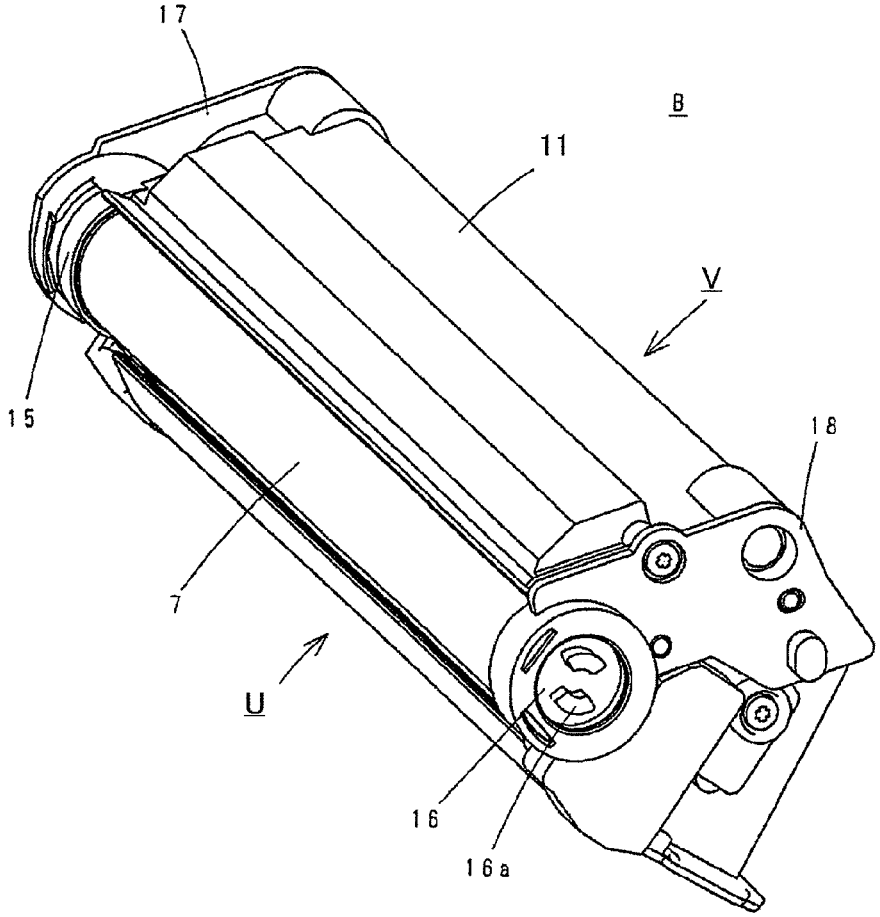
FIG. 8 is a perspective view of the process cartridge in the second preferred embodiment of the present invention, and shows the general structure of the process cartridge.

Next, the second preferred embodiment of the present invention is described. FIG. 8 is a perspective view of the process cartridge B in this embodiment. This embodiment is different from the first embodiment in that in this embodiment, the coupling portion of the process cartridge B, through which the photosensitive drum 7 receives driving force from the main assembly of the image forming apparatus, is a part 16*a* of the stopper 16 attached to the lengthwise end of the photosensitive drum 7, which was the bottom end when the cylindrical substrate for the photosensitive drum 7 was vertically dipped into the solution of the photosensitive substance to coat the peripheral surface of the cylindrical substrate with the photosensitive substance. In the following description of this embodiment, the lengthwise end of the photosensitive drum 7, which is fitted with the stopper 16, is referred to as "power transmission end". First, the drum supporting mechanism, which supports the "power transmission end" is described.

(Mechanism for Supporting Power Transmission End of Photosensitive Drum)

Figure 9:
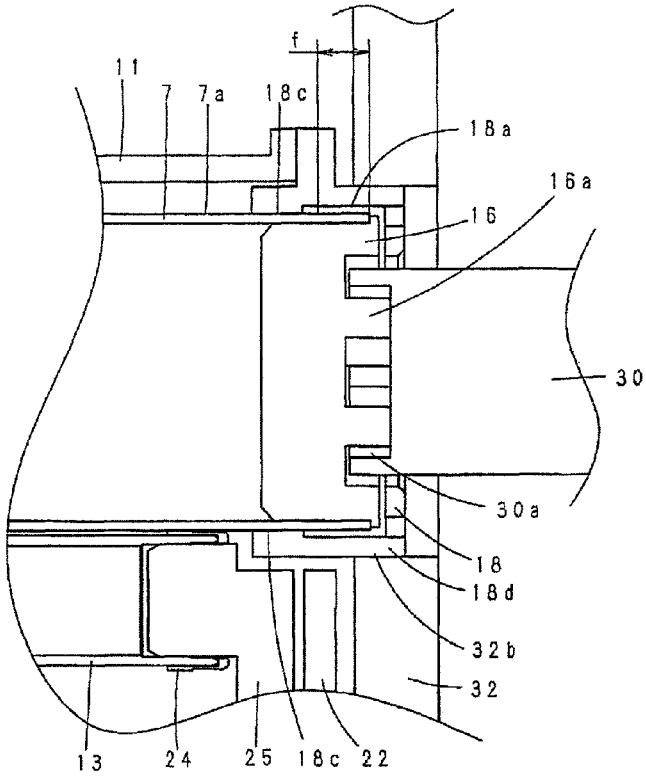
FIG. 9 is a schematic drawing of the mechanism for supporting the lengthwise end of the photosensitive drum, by which the photosensitive drum is driven, in the second preferred embodiment.
Figure 9:
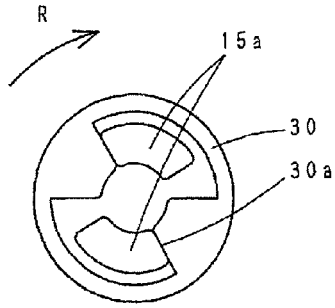

FIG. 9(*a*) is a schematic sectional view of the joint between the power transmission end of the photosensitive drum 7 and the corresponding drum supporting mechanism. The following is the process through which the photosensitive drum 7 is precisely positioned relative to the main assembly of the image forming apparatus, in this embodiment. That is, first, the peripheral surface of the photosensitive layer 7*a* comes into contact with the flat portions 18*c* of the inward surface of the cylindrical portion 18*a* of the drum bearing 18 as in the first embodiment. Then, the drum positioning portion 18*d* of the drum bearing 18 comes into contact with the drum positioning portion 32*b* of the guiding member 32.

In this embodiment, the stopper 16 attached to one of the ends of the photosensitive drum 7 in terms of the axial direction is provided with the coupling portion 16*a* for driving the photosensitive drum 7. However, unlike the coupler portion 15*a* in the first embodiment, the coupling portion 16*a* (male coupler) does not play the role of precisely positioning the photosensitive drum 7 relative to the main assembly of the image forming apparatus, for the following reason. That is, referring to FIG. 9(*b*), the coupling portion 16*a* of the stopper 16 and the coupling recess 30*a* of the coupler 30 are shaped only for mechanical power transmission; they are not shaped for aligning the axial line of the stopper 16 and coupler 30.

(Mechanism for Supporting Opposite End of Photosensitive Drum from Power Transmission End)

Figure 10:
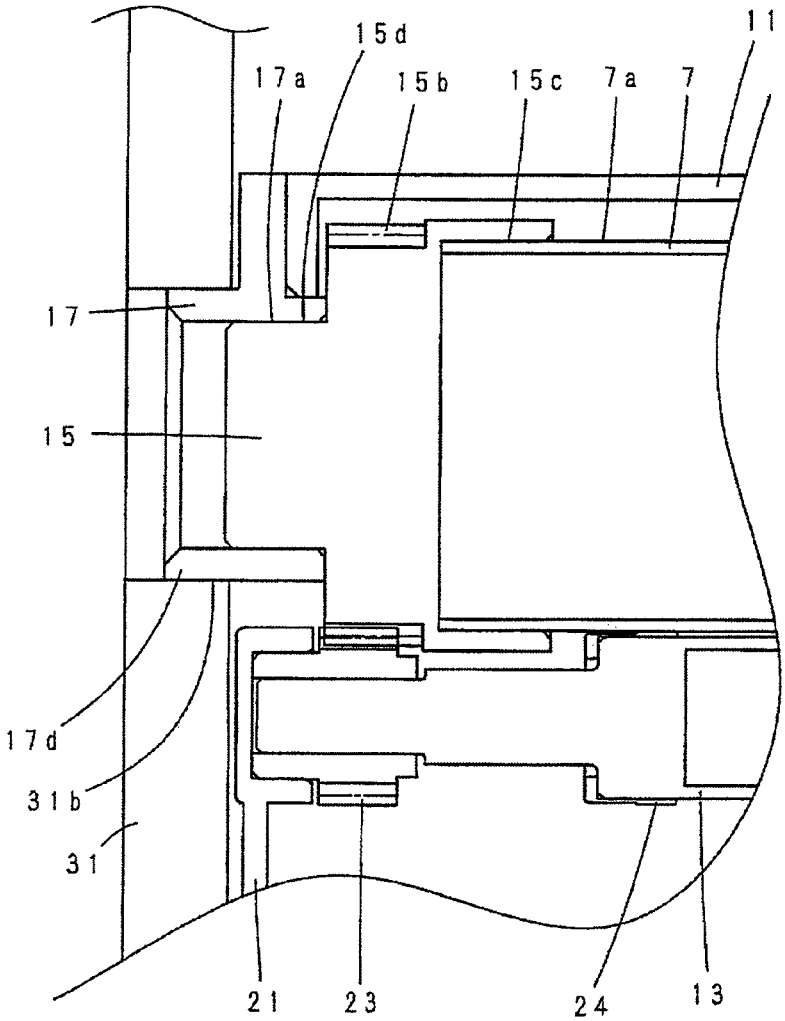
FIG. 10 is a schematic drawing of the mechanism for supporting the lengthwise end of the photosensitive drum, by which the photosensitive drum is not driven, in the second preferred embodiment.

Next, referring to FIG. 10, the mechanism for supporting the lengthwise end of the photosensitive drum 7, which is opposite from the power transmission end, is described. The stopper 15 is fitted around one of the lengthwise ends of the photosensitive drum 7, and the shaft portion 15*d* of the stopper 15 is fitted in the hole of the cylindrical portion 17*a* of the drum bearing 17 with the presence of no gap between the peripheral surface of the shaft portion 15*d* and the cylindrical portion 17*a*, whereby the stopper 15 is solidly attached to the main assembly of the image forming apparatus and is precisely position relative to the main assembly, as in the first embodiment.

This embodiment is different from the first embodiment in that in this embodiment, the guiding member 31 has the function of precisely positioning the photosensitive drum 7. That is, there is no large gap between the guiding surface of the groove 31*b* of the guiding member 31, and the drum positioning portion 17*d* of the drum bearing 17, as shown in FIG. 10. Thus, the photosensitive drum 7 is precisely position relative to the main assembly of the image forming apparatus by these portions.

Also in the case of the structural features described above, the photosensitive drum 7, the photosensitive layer 7*a* of which was formed by the dip-coating, is supported by the drum supporting mechanism, directly by its peripheral surface. This structural feature can improve an image forming apparatus in the accuracy with which its photosensitive drum is rotated, regardless of the nonuniformity of the cylindrical substrate for the photosensitive drum in terms of wall thickness.

Further, the photosensitive drum 7 is supported by the portion of the photosensitive drum 7, which is inward of the portion of the photosensitive drum 7 in the range f in which the photosensitive drum 7*a* is thicker than outside the range f because of the downward settling of the coated solution of the photosensitive substance and/or nonuniformity in the line of separation of the body of the solution of the photosensitive substance on the peripheral surface of the cylindrical substrate, from the body of solution of the photosensitive substance in the dip-coating vat. This structural feature prevents the portion of the photosensitive drum 7 in the range f from affecting the accuracy with which the photosensitive drum 7 is rotated, and therefore, can improve an image forming apparatus in the accuracy with which the photosensitive drum 7 is rotated.

Further, this structural feature can simplify the mechanism which supports the photosensitive drum 7, and therefore, can prevent the imprecision of the components for the drum supporting mechanism and photosensitive drum 7 from affecting the accuracy with which the photosensitive drum 7 is rotated.

[Effects of Invention]

According to the present invention, it is possible to improve an electrophotographic photosensitive drum, the photosensitive layer of which is formed by dip-coating, in the accuracy with which it is rotated. Therefore, the present invention can improve in image quality an image forming apparatus which employs an electrophotographic photosensitive member, the photosensitive layer of which is formed by dip-coating.

Also according to the present invention, it is possible to simplify the mechanism for supporting an electrophotographic photosensitive drum. Therefore, the present invention can minimize the effect of the imprecision of the components related to the electrophotographic photosensitive drum and drum supporting mechanism, upon the accuracy with which the drum is rotated.

INDUSTRIAL APPLICABILITY

According to the present invention, the present invention provides an electrophotographic photosensitive drum, the photosensitive layer of which is formed by the dip-coating method, and yet is significantly superior in the accuracy with which it is rotatable, being therefore significantly better in image quality than any electrophotographic photosensitive drum in accordance with the prior arts.

In addition, the present invention simplifies a mechanism for supporting an electrophotographic photosensitive drum, in order to minimize the effects of the imprecision of the components of the drum supporting mechanism, upon the accuracy with which an electrophotographic photosensitive drum is rotatable.

While the invention has been described with reference to the structures disclosed herein, it is not confined to the details set forth, and this application is intended to cover such modifications or changes as may come within the purposes of the improvements or the scope of the following claims.

The invention claimed is:

1. A supporting mechanism supporting an electrophotographic photosensitive drum having a photosensitive layer formed through a dip-coating on a peripheral surface of a cylindrical member, said supporting mechanism comprising:

a bearing member supporting one end side of the electrophotographic photosensitive drum, wherein said one end side is a side that took a lower position in the dip-coating, wherein said bearing member supports the electrophotographic photosensitive drum by contacting a position of the photosensitive layer that is away from an end portion of the photosensitive layer toward an axially central portion of the electrophotographic photosensitive drum, and wherein the photosensitive layer slides on said bearing member when the electrophotographic photosensitive drum rotates.

2. A supporting mechanism according to claim 1, wherein said bearing member includes (i) a hole portion through which the end portion of the photosensitive layer is capable of passing when said bearing member is mounted to the electrophotographic photosensitive drum and (ii) a supporting portion provided at an inner surface of said hole portion and contactable to the photosensitive layer.

3. A supporting mechanism according to claim 2, wherein said supporting portion includes two flat surfaces effective to bear a resultant force of forces applied by said bearing member to the electrophotographic photosensitive drum.

4. A supporting mechanism according to claim 1, further comprising a supporting member for supporting another side of the electrophotographic photosensitive drum that is opposite from the one end side, wherein said supporting member supports the electrophotographic photosensitive drum by contacting a peripheral surface of the electrophotographic photosensitive drum.

5. A supporting mechanism according to claim 1, further comprising a driving transmission member, engaged with an inside of the cylindrical member and the one end side, for receiving a driving force from a main assembly of an electrophotographic image forming apparatus to transmit the driving force to the electrophotographic photosensitive drum.

6. A process cartridge detachably mountable to a main assembly of an electrophotographic image forming apparatus, said process cartridge comprising:

an electrophotographic photosensitive drum;

process means actable on said electrophotographic photosensitive drum; and a drum supporting mechanism according to claim 1.

7. An electrophotographic image forming apparatus for forming an image on a recording material, comprising:

a process cartridge according to claim 6.

8. An electrophotographic image forming apparatus for forming an image on a recording material, comprising:

an electrophotographic photosensitive drum;

process means actable on said electrophotographic photosensitive drum; and a drum supporting mechanism according to claim 1.

9. A supporting mechanism according to claim 1, wherein the electrophototgraphic photosensitive drum has a thick layer portion adjacent to an axially end portion of the electrophotographic photosensitive drum where a thickness of the photosensitive layer is thicker adjacent to the one end side than in an axially central portion, and wherein said bearing member contacts a position of the photosensitive layer that is away from the thick layer portion toward the axially central portion.

10. A supporting mechanism according to claim 9, wherein said bearing member does not contact the thick layer portion.

11. A supporting mechanism according to claim 1, wherein said bearing member does not contact the end of the photosensitive layer.

12. A supporting mechanism supporting an electrophotographic photosensitive drum having a photosensitive layer formed through a dip-coating on a peripheral surface of a cylindrical member, said supporting mechanism comprising:

a bearing member supporting an end side of the electrophotographic photosensitive drum, wherein the electrophotographic photosensitive drum has a thick layer portion adjacent to an axially end portion of the electrophotographic photosensitive drum where a thickness of the photosensitive layer is thicker than in an axially central portion of the electrophotographic photosensitive drum, wherein said bearing member supports the electrophotographic photosensitive drum by contacting a position of the photosensitive layer that is away from the thick layer portion toward the axially central portion, and wherein the photosensitive layer slides on said bearing member when the electrophotographic photosensitive drum rotates.

13. A supporting mechanism according to claim 12, wherein said bearing member does not contact the thick layer portion.

* * * * *